US010005656B2

(12) United States Patent
Sheehy

(10) Patent No.: US 10,005,656 B2
(45) Date of Patent: Jun. 26, 2018

(54) TAP BLASTER

(71) Applicant: Kevin Barry Sheehy, Chicago, IL (US)

(72) Inventor: Kevin Barry Sheehy, Chicago, IL (US)

(73) Assignee: Kevin Barry Sheehy, Chicago, IL (US)

( * ) Notice: Subject to any disclaimer, the term of this patent is extended or adjusted under 35 U.S.C. 154(b) by 42 days.

(21) Appl. No.: 14/545,564

(22) Filed: May 21, 2015

(65) Prior Publication Data

US 2016/0340167 A1 Nov. 24, 2016

Related U.S. Application Data

(60) Provisional application No. 61/997,142, filed on May 21, 2014.

(51) Int. Cl.

| | |
|---|---|
| ***B67D 1/07*** | (2006.01) |
| ***B65D 39/16*** | (2006.01) |
| ***B08B 9/032*** | (2006.01) |

(52) U.S. Cl.

CPC ..... *B67D 1/07* (2013.01); *B08B 9/032* (2013.01); *B65D 39/16* (2013.01); *B08B 2209/022* (2013.01)

(58) Field of Classification Search

CPC ..... B65D 51/2864; B67D 1/16

USPC ..... 141/86, 311 A; 220/735, DIG. 19, 220/DIG. 5, 751, 212; 248/212; 215/399

See application file for complete search history.

(56) References Cited

U.S. PATENT DOCUMENTS

| | | | | |
|---|---|---|---|---|
| 3,119,541 A * | 1/1964 | Lynn | B65D 51/242 206/806 |
| 3,304,039 A * | 2/1967 | Edelman | A47K 1/09 206/806 |
| 3,637,104 A * | 1/1972 | Dutnell | B65D 17/506 220/250 |
| 7,988,019 B2 * | 8/2011 | Groh | B67D 1/1405 15/211 |
| 2005/0199631 A1 * | 9/2005 | Alois | B65D 39/0005 220/375 |

* cited by examiner

*Primary Examiner* — Timothy L Maust
*Assistant Examiner* — Timothy P Kelly

(57) ABSTRACT

This application relates to a device called the Tap Blaster (FIG. 1) used to create a back flow in a draft beer system apparatus more particularly the faucet causing system pressure and product to be harnessed to clean openings (FIG. 7 and FIG. 9) such as air vents, mechanical channels and apparatus internal parts and side walls that tend to become contaminated by fermented bacteria growth caused by but not limited to air, natural light and inactivity between operation and scheduled cleanings.

6 Claims, 5 Drawing Sheets

TAP BLASTER

CROSS-REFERENCE TO RELATED APPLICATION

This application claims the benefit of provisional patent application Ser. No. 61/997,142, filed 2014 May 21.

FEDERALLY SPONSORED RESEARCH

Not Applicable

SEQUENCE LISTING OR PROGRAM

Not Applicable

BACKGROUND

Field

This application relates to a plug apparatus and more particularly to a device for power washing and flushing the interior components and faucets body walls of draft beer tap faucets.

Background of Invention

It has been a challenge for over a century for brewers of draft distributed beer to deliver the Brew Masters quality product to the serving establishment and have the same quality at the faucet where it pours out and into the consumers glass as it does at the brewery itself. When handled properly from brewery to serving establishment, draft beer offers what many consider to be the freshest most flavorful beer available to the consumer. The job does not end once the keg is tapped and the beer begins to flow. Good beer quality depends consistant proper housekeeping practices. This intails cleaning and maintenance scheduled every two weeks (14 days) with a warm water caustic solution of greater than 1% no more than 3% circulated through the system and flushed with copious amounts of cold water until PH matches that of tap water or a reading of 7 PH and no visible impurities being carried from the system faucet opening ports.

It is at the faucet between cleanings where we experience surface contamination on the interior of the faucet body parts and open orifices such as air vents and channel shafts that prevents smooth uncontaminated pours that effect the quality of the serving product, presentation and unnecessary waste due to foamy pour overs. Since this is where the product first comes in contact with oxygen and light that both accelerate spoilage of product. When the handle of a draft beer faucet is opened to pour and then closed, the interior of the faucet is laced with residual product that lines the walls of the faucet body and its parts. Some of these areas remain exposed to ambient air due to vents, pour spout opening and other orifaces. This becomes a breading ground for bacteria such as *Lactobacillus, Pediococcus* and *Pestinatius* on both sides of the closed faucet. These bacterias clog and block necessary orifaces of the faucet and build up on parts causing blocked air vents, mechanical resistance and an overall hampering of smooth operation. Build up of bacteria inside the fauce causes serving product to soak with contaminates and wash over them on the next pour pour when leaving the faucet. There are some small brushes on the market used to insert into faucet overnight, when pulled out in the morning brush the interior of the faucet but do nothing for interior parts or open orifices and tend to collect bacteria overnight.

Accordingly there is a need for a device for blast power cleaning/power washing of draft beer faucets inner components on a daily or shift changing bases that will discharge all such bacterias and impurities and forming solids (known as floaters) between industry cleaning.

BRIEF DESCRIPTION OF FIG. 1-8

FIG. 1 A perspective view of invention.

FIG. 2 A underside perspective view of invention.

FIG. 3 A operational view of invention in a discharge port, hanging on catch all container.

DETAILED DESCRIPTION—FIG. 1-8

Figure 1:
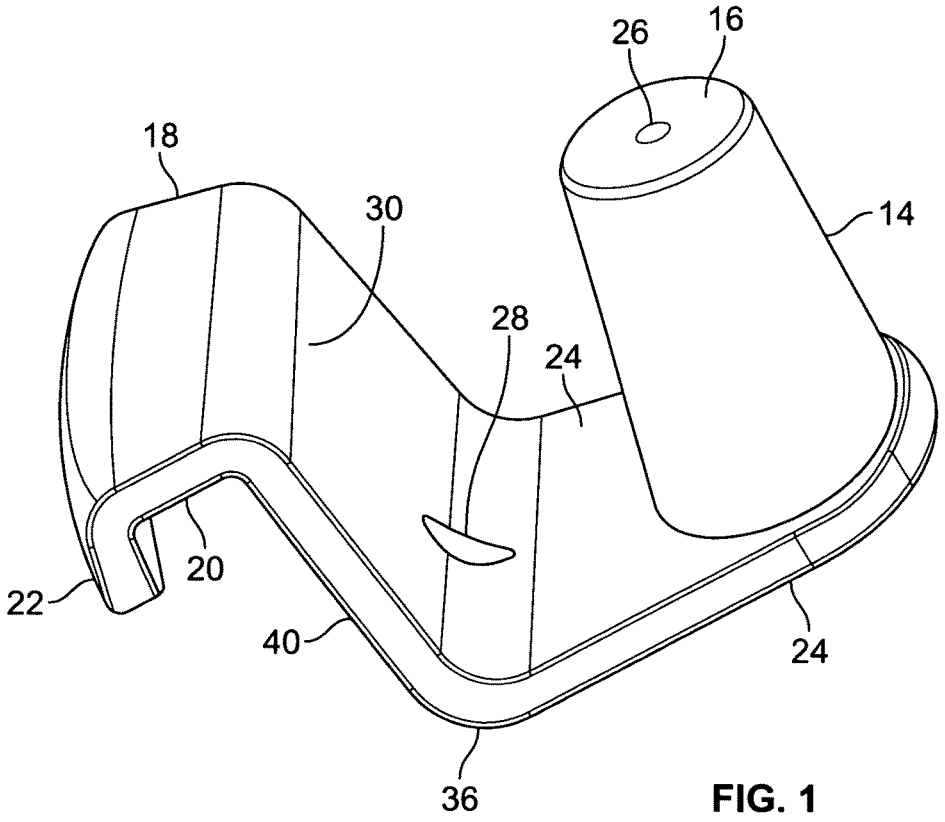
Figure 2:
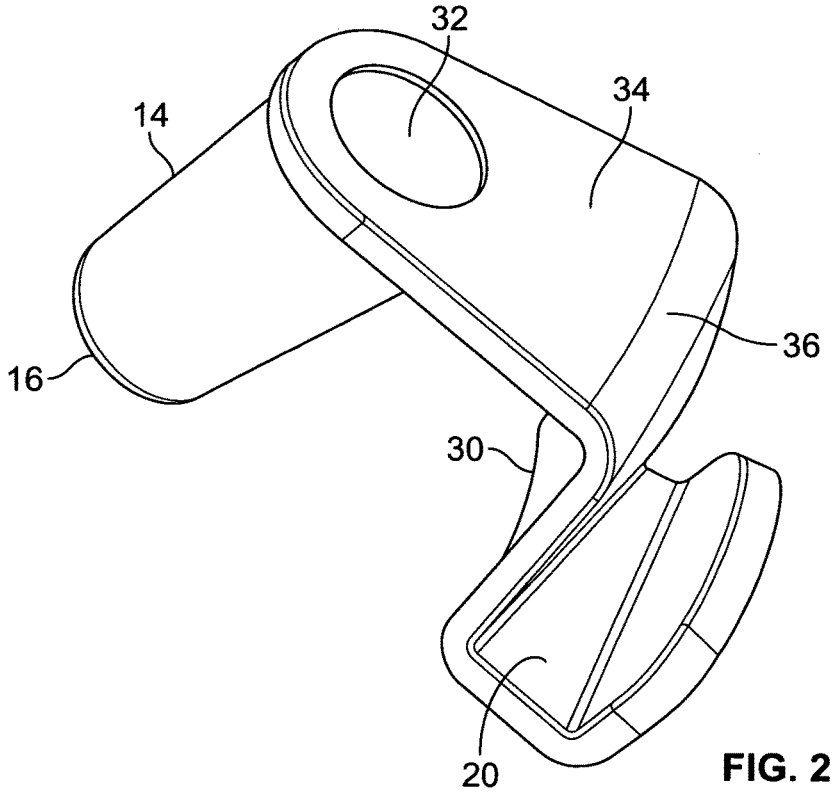
Figure 3:
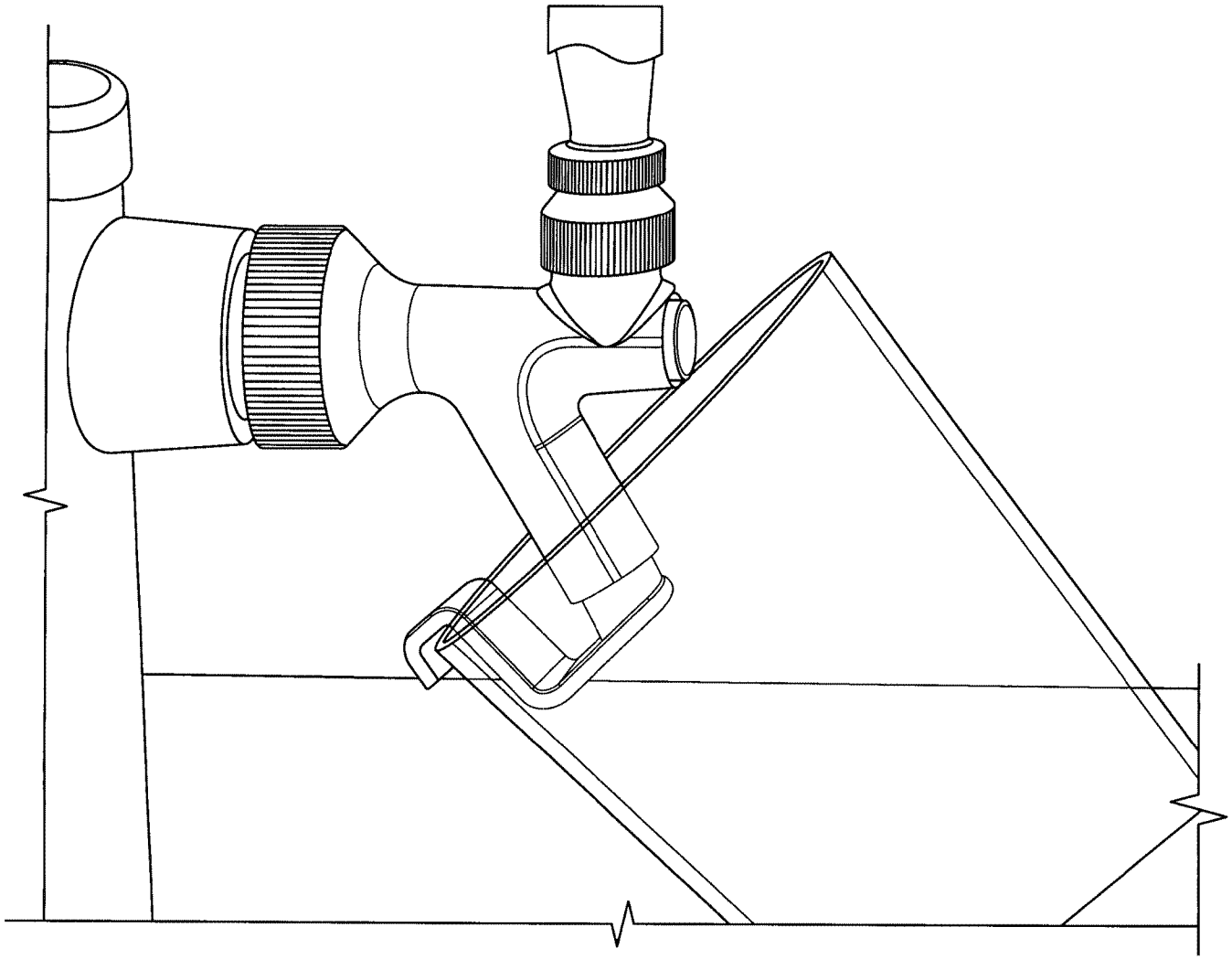

This invention relates to a plug stopper/diverter also known as "The Tap Baster" to be used to insert in a draft beer faucet spout prior to serving or after periods of inactivity. This allows for the draft beer systems product and pressure to be engaged, to backwash and create cavitation inside the faucet to release surface mounted and solid forming impurities, while flushing any open orifices that may be clogged as a result FIG. 1-2 are two present faucet flushing embodiments. FIG. 3 is a present embodiment in operation.

FIG. 1 The plug stopper/diverter comprises a base 24 with plug 14 rising vertically at an angle to cap 16 with an optional orifice 26 to help reduce pressure on device when used on systems with high pressure. Base 28. Vertical spine poster 40 rises vertically to hook 20 that is designed to rest on the rim of catch all receptacle like a pint glass seen in FIG. 3. Top 18 is used to place fingers, preferably index, during operation. Lip 22 travels downwardly on outside of pint glass put in place during operation. 40 vertical back posterior and 30 vertical anterior are curved to accommodate the curvature of a glass and when hung on the rim of glass by the lip 20. 40 and 30 extend downwardly into pint glass to such a depth as to help contain all liquids and impurities being released during operation.

FIG. 2 is the underside of invention Plug stopper/diverter (The Tap Blaster) comprised of a base 34 underside with a cavity opening 32 that rises up angularly on interior of plug 14 to underside of cap 16. Cavity 32 allows for pressure reducing (in volume not velocity) liquids to flow through when using optional orifices 26 on underside of cap 16.

FIG. 3 displays operation with a pint glass. When pint glass is cupped with hand and forward pressure on glass is applied upwardly and index finger covering 18 top (see FIG. 1) the faucet is ready to be opened. Resulting in pressure being sent back through faucets causing product to loosen up contaminate and being forced out any open orifices applicable to the type of faucet. After closing faucet with free hand, plug stopper/diverter is removed by applying downward pressure on pint glass with index finger stiffly remaining ridged on top 18 FIG. 1 to unplug opening from plug 14 FIG. 1 to release solid contaminants and liquid pressure into pint glass still standing by.

When faucet is completely opened, liquid and contaminants will blow out shaft orifices FIG. 3 (front of faucet) and as it slowly closed go out air vent on underside of faucet.

It is important to point out that FIG. 3 may not capture the throttling motion of the faucet handle (backwards and forwards motion) that we are referring to as opened and closed, product would exit the shaft orifices as well once fully opened and then exit the air vent with the closing of the handle and there would be an intermittent of product exiting through both during mid motion. It is equally important to understand that different draft beer systems operate at different pressures affecting the velocity at which products would exit faucet and into our glass. These pressures typically run between 10 psi. to 30 psi. It is important to know when choosing a catch all container. We have chosen a 16 oz. pint glass but you may find that you need a 22 oz. glass or a bucket depending on the individual. This is why we have included on optional orifice FIG. 1 26. This will help with operators with more fragile strength on systems with greater pressure.

DETAILED DESCRIPTION—FIGS. 4-8/OPERATION OF ALTERNATIVE MODES OF INVENTIONS

Figure 7:
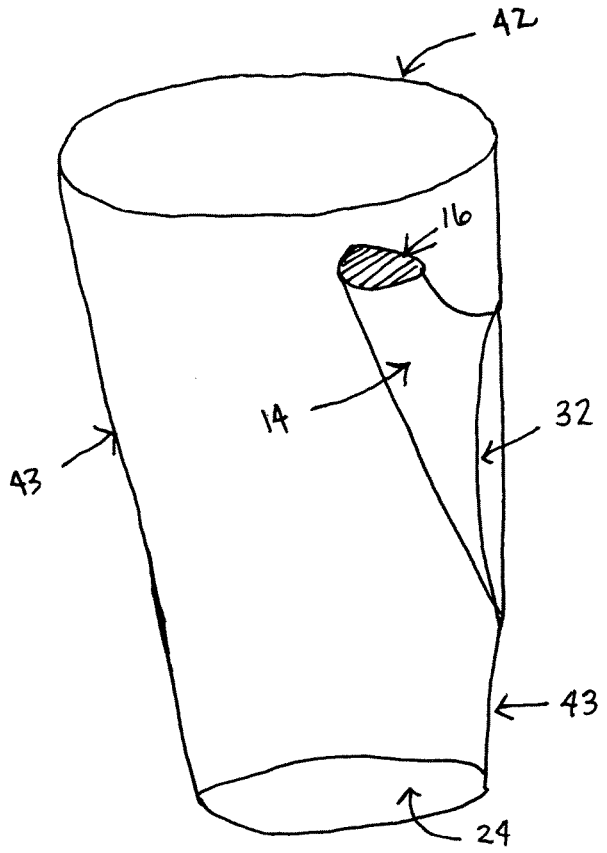
FIG. 7 Is a alternate embodiment of invention built into side wall of catch all container.

FIG. 7 is an overall view of cup 43 with a plug 14 injection molded in the side 32 cavity used as one piece to insert into beer faucet with cap 16 to get the desired results of s flushed faucet into cup 43.

Figure 8:
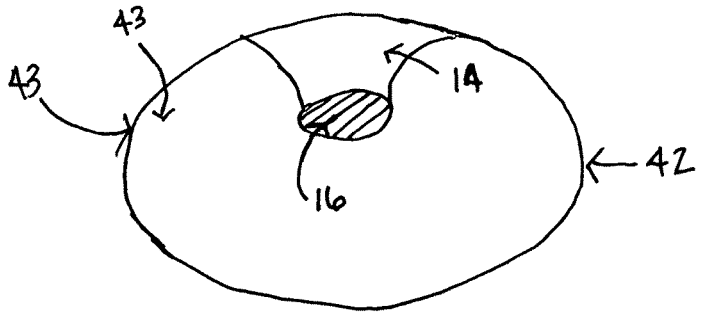
FIG. 8 Is a top view of FIG. 7

FIG. 8 is a top in cup view of FIG. 7.

Figure 5:
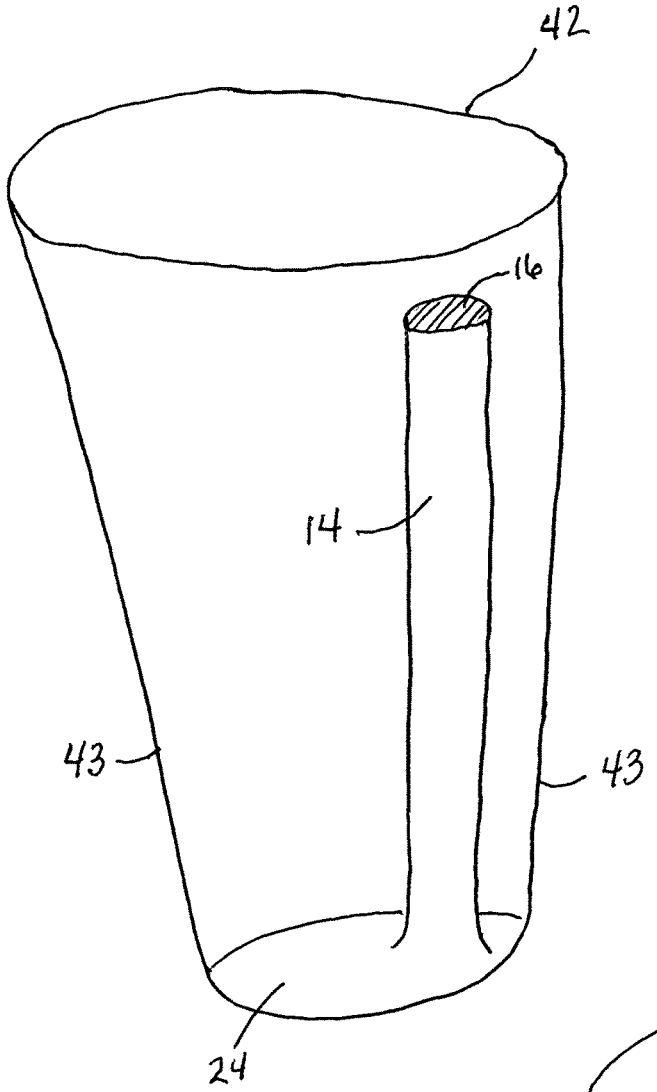
FIG. 5 Is a alternate embodiment of invention built into base of catch all container.

FIG. 5 is an overall view of a cup 43 with cap 16 to get desired effect of flushed faucet 43.

DRAWING—REFERENCE NUMERALS

Figure 6:
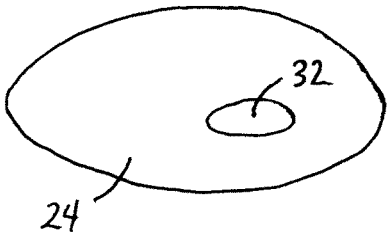
FIG. 6 Is a bottom view of alternate invention of FIG. 5.

14 a plug
16 a cap
18 top
20 hook
22 lip
24 a base
26 an orifice
28 a spine
30 vertical coved anterior
32 a cavity/cavity opening
34 a base underside
36 coved joint
38 finger handle
40 a vertical coved back posterior
41 flexible neck/system
42 rim
43 cup FIG. 6 is a bottom view of FIG. 5 that shows a cavity opening 32 on bottom of cup 43 base 24.

Figure 4:
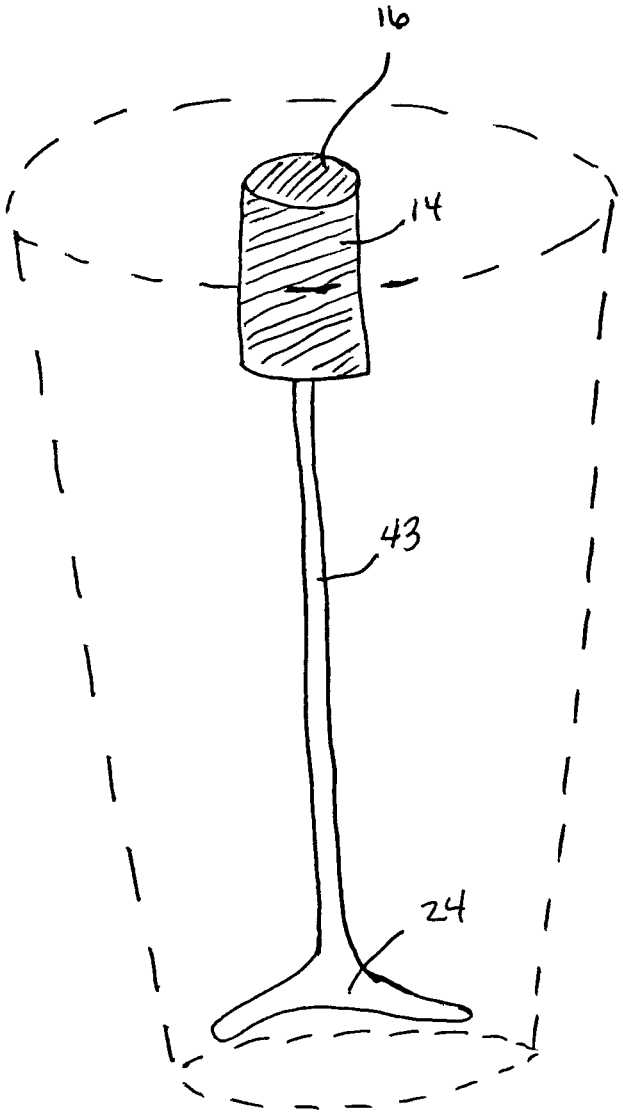
FIG. 4 Is a alternate embodiment of invention placed in a catch all container.

FIG. 4 is a plug 4 stem 43 that is inserted into a faucet by way of cap 16 plug 14 and is pushed up from base 24 by the bottom of a catch all container.

The invention claimed is:

1. A stopper configured to be inserted into a faucet and configured to engage a container for collecting liquid from the faucet, the stopper comprising:

a base having a top surface;

a conical plug extending upwards from a first side of the top surface at an angle relative to vertical, wherein the conical plug is configured to be inserted into a discharge port of the faucet;

a hook extending upwards from a second side of the top surface, wherein the hook is configured to engage a rim of the container when the plug is inserted into the discharge port, and wherein the first side is opposite the second side.

2. The stopper of claim 1, wherein the hook comprises a vertical wall configured to conform to a wall of the container.

3. The stopper of claim 1, wherein the conical plug comprises a cap on a distal end of the conical plug opposite the base.

4. The stopper of claim 3, wherein the cap comprises an orifice.

5. The stopper of claim 4, wherein the base comprises a cavity on a bottom surface, wherein a passage for liquid is provided between the orifice and the cavity, wherein the container catches liquid which passes from the faucet through orifice, into the passage, and out the cavity.

6. A method of backwashing and collecting liquid from a faucet, the method comprising:

providing a stopper comprising:

a base having a top surface;

a conical plug extending upwards from a first side of the top surface at an angle relative to vertical, wherein the conical plug is configured to be inserted into a discharge port of the faucet;

a hook extending upwards from a second side of the top surface, wherein the hook is configured to engage a rim of the container when the plug is inserted into the discharge port, and wherein the first side is opposite the second side;

inserting the plug into the discharge port of the faucet;

engaging the hook with the container;

throttling a handle of the faucet so as to repeatedly open and close a valve of the faucet, thereby loosening contaminates; and catching liquid dripping from the faucet in the container.

* * * * *